United States Patent [19]

Clement

[11] Patent Number: 4,539,715

[45] Date of Patent: Sep. 10, 1985

[54] SIZE ADJUSTABLE HELMET

[75] Inventor: Leonard W. H. Clement, Bolton, Canada

[73] Assignee: Cooper Canada Limited, Toronto, Canada

[21] Appl. No.: 487,878

[22] Filed: Apr. 22, 1983

[51] Int. Cl.[3] ..... A42B 3/00

[52] U.S. Cl. ..... 2/420; 2/425

[58] Field of Search ..... 2/425, 417, 418, 419, 2/420, 5, 6, 7, 410, 10, 424, 9, 184.5, 171.3; 24/191, 263 B, 273

[56] References Cited

U.S. PATENT DOCUMENTS

| | | | |
|---|---|---|---|
| 238,247 | 3/1881 | Parsons | 24/191 |
| 3,204,251 | 9/1965 | Child | 2/420 |
| 3,805,294 | 4/1974 | Rose et al. | 2/10 |
| 3,897,597 | 8/1975 | Kasper | 2/10 X |
| 4,404,690 | 9/1983 | Farquharson | 2/425 X |
| 4,476,589 | 10/1984 | Burgin et al. | 2/184.5 |
| 4,477,929 | 10/1984 | Mattsson | 2/417 X |

FOREIGN PATENT DOCUMENTS

| | | | |
|---|---|---|---|
| 0096148 | 12/1983 | European Pat. Off. | 2/411 |
| 0451483 | 8/1936 | United Kingdom | 2/411 |

*Primary Examiner*—Peter Nerbun

*Attorney, Agent, or Firm*—Sim & McBurney

[57] ABSTRACT

A helmet having a front shell and a rear shell movable with respect to each other. Portions of the two shells overlap each other and present mating surfaces which can engage to retain the shells in a given overlapping position and can disengage to allow the shells to change their relative position. A device is provided for selectively (a) holding the mating surfaces in engagement, or (b) releasing them to disengage.

2 Claims, 4 Drawing Figures

SIZE ADJUSTABLE HELMET

This invention relates generally to helmets for use in hockey and other sports, and has to do particularly with an adjustable helmet which incorporates a manual, snap-action adjustment means by which to quickly and securely change the size of the helmet.

BACKGROUND OF THIS INVENTION

Adjustable helmets are already known. As a general rule, the conventional adjustable helmets achieve adjustability through the utilization of fastening members which must be unscrewed to permit adjustability, and then screwed tight to lock the parts in relative position after adjustment.

It would be highly desirable to provide an adjustable sports helmet in which adjustment could be accomplished very quickly and manually in the field, so to speak, without requiring hand tools. For example, if a young hockey player should borrow his brother's helmet and then find, after he has begun playing a game, that the helmet has been adjusted too small or too large for his own head, it is very inconvenient for him to take the time necessary to find the appropriate tool, unscrew the fasteners, adjust the helmet, and then screw the fasteners tight. It would be far preferable if the player could, while still having the helmet on his head, simply accomplish a manual operation which would allow adjustment of the helmet to a different size.

GENERAL DESCRIPTION OF THIS INVENTION

Accordingly, it is an aspect of this invention to provide a sports helmet which is readily, manually adjustable, and which, if desired, can be manually adjusted while being worn.

More particularly, this invention provides a helmet comprising a front shell, a rear shell movable in the forward-rearward direction with respect to the front shell, portions of the two shells overlapping each other and presenting mating surfaces with interengageable protuberances which can engage each other to retain the shells in a given overlapping position, and can disengage to allow the shells to change their relative position, and cam means for selectively (a) holding the mating surfaces in engagment, and (b) releasing them to disengage, the cam means including two cam members recessed into two recesses on either side of the said portion which lies outwardly of the other, each cam member being swivelable about an axis which is restrained with respect to the inwardly lying mating surface, each cam member being adapted to urge the two mating surfaces into engagement, each cam member being integral with a cam-operating lever which is accessible from the exterior of the helmet and by which the cam member can be rotated about is respective axis, each said lever being wholly recessed into the recess of its respective cam member when the latter is urging the two mating surfaces into engagement, each said lever being swingable to a position in which it extends generally outwardly away from the helmet, in which position the cam member releases the mating surfaces.

Another drawback of many conventional sports helmets relates to their weight. Because of the tests which safety organizations require sports helmets to be put through, most manufacturers currently must utilize a substantial thickness of material in order to have their helmets pass the appropriate tests. Another problem relates to ventilation. It is highly desirable, particularly for very energetic sports like hockey, to have vent holes in the helmet, through which air can circulate past the player's head. However, to simply provide vent holes in a standard smooth-shelled helmet would further weaken the material, and require the manufacturer to use an even thicker shell in order to compensate.

Another problem with vent holes is the danger that sharp objects, like the point of a hockey stick, could strike the helmet at the location of one of the vent holes, cause localized stress concentration sufficient to rupture the helmet material, and thus penetrate through the helmet and injure the player. In order to prevent this from happening, ideally the helmet should be constructed in such a way as to prevent objects such as hockey sticks from contacting the helmet where the vent holes are located.

Accordingly, it is a further aspect of this invention to provide a helmet which is vented, but which provides the vents at the bottom of grooves defined by ribbing, so that the upwardly projecting ribs keep sharp objects away from the vent holes, while the ribs themselves provide sufficient strength to compensate for the presence of the vent holes, thus allowing a minimization of the thickness of the material employed.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
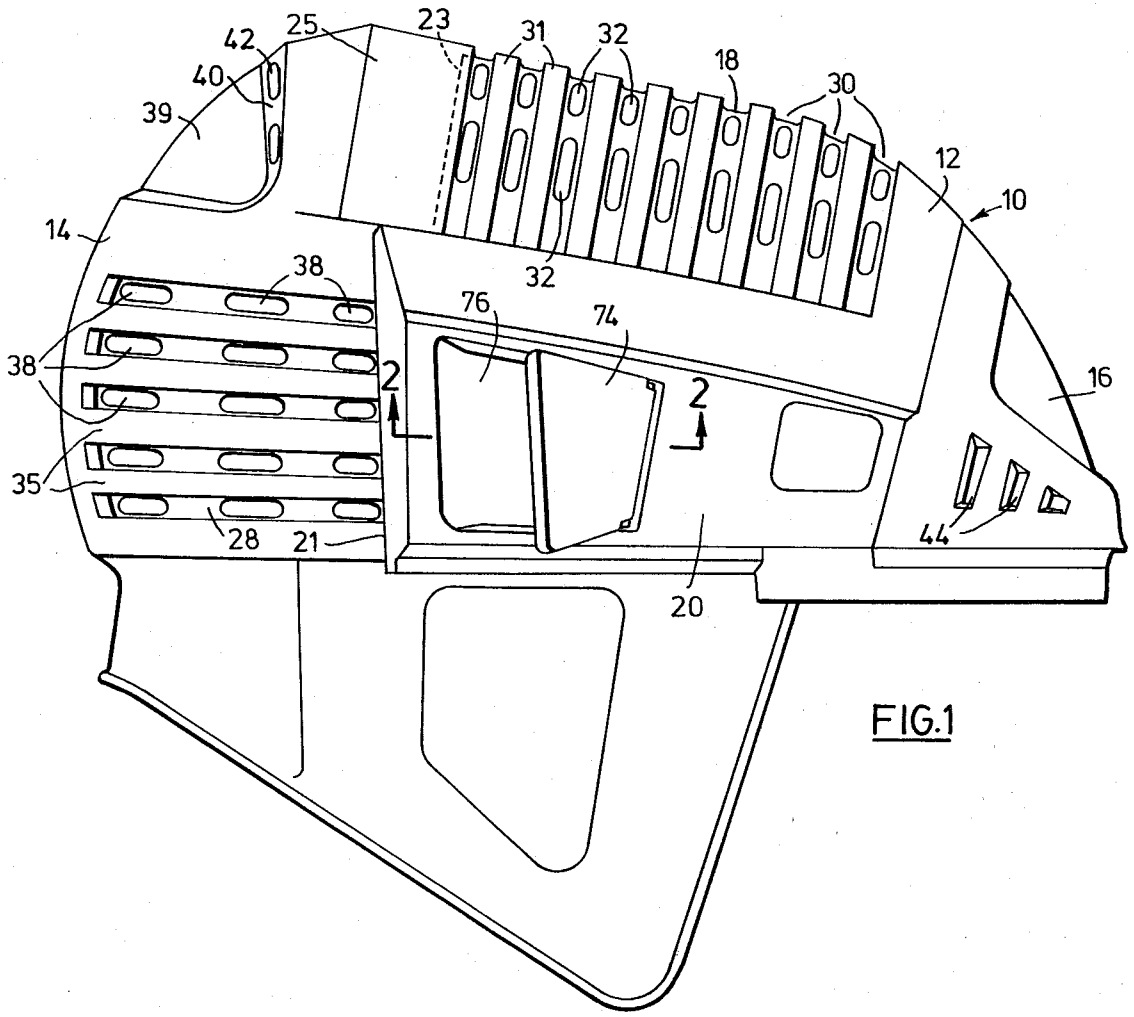
FIG. 1 is a side elevational view of a helmet incorporating the present invention.

Attention is first directed to FIG. 1, which shows a helmet 10, which may typically be a hockey helmet. The hockey helmet includes a front shell 12 and a rear shell 14. The front shell 12 has a front visor portion 16, a top wall 18, and a side portion 20. The side portion 20 terminates at a rear edge 21, which lies to the outside of the rear shell 14. Conversely, the top wall 18 has a rearward edge shown in broken lines at 23, and which fits just inside a top wall 25 of the rear shell 14. The top wall 25 of the rear shell 14 effectively telescopes over the top wall 18 of the front shell 12, to permit longitudinal front-to-rear sliding of the one shell with respect to the other.

A similar overlapping or telescoping relationship exists between the side portion 20 of the front shell 12 and the side wall 28 of the rear shell 14. These slide with respect to each other, with the side portion 20 of the front shell lying to the outside of the side wall 28 of the rear shell 14.

As can be seen in FIG. 1, the top wall 18 of the front shell 12 is ribbed to define a plurality of parallel grooves 30, each having apertures 32 in their bottoms. As illustrated, the apertures 32 are arranged in parallel back-to-front rows, although this is of course not essential. Nore is it essential to have apertures 32 in each of the grooves 30. The purpose of the apertures 32 is to provide vent holes so that the interior of the helmet can be vented while also being regidified by the ribbing lying between the grooves 30. In addition, the apertures 32 themselves are protected by the ribbing 31.

Because of the increase in strength provided by the ribbing 31, the actual thickness of the material of the top wall 18 can be reduced to a minimum. On the inside, the top wall 18 exactly follows the contours of the ribbing 31, so that the thickness remains constant throughout. It will be apparent from an inspection of FIG. 1 that, since the ribs 31 rise up on either side of any given aperture 31, that aperture will be protected from direct impact by objects such as hockey sticks and the like.

Similar ribbing 35 and apertures 38 are provided in the two side walls 28 of the rear shell 14, again for the same purposes. Finally, the rear shell 14 has a slightly indented portion 39 surrounded by a step 40 which likewise contains apertures 42 for venting purposes. Further vents 44 are provided in the lower forward portion of the front shell 12.

Figure 2:
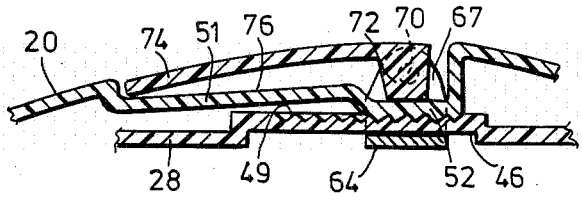
FIG. 2 is a sectional view taken at the line 2—2 in FIG. 1, with the adjustment lever closed.

Attention is now directed to FIG. 2, in conjunction with the other figures, in which the side wall 28 of the rear shell 14 has been partly illustrated in section. It can be seen that the side wall 28 includes a raised portion 46 having parallel teeth 49 (extended in a plane at right angles to the paper in FIG. 2). Also shown in FIG. 2 is the side portion 20 of the front shell 12. The side portion 20 has an indented region 51, and the latter includes an inwardly displaced portion 52 which also presents parallel teeth adapted to mesh or engage with the teeth 49 on the raised portion 46.

Figure 3:
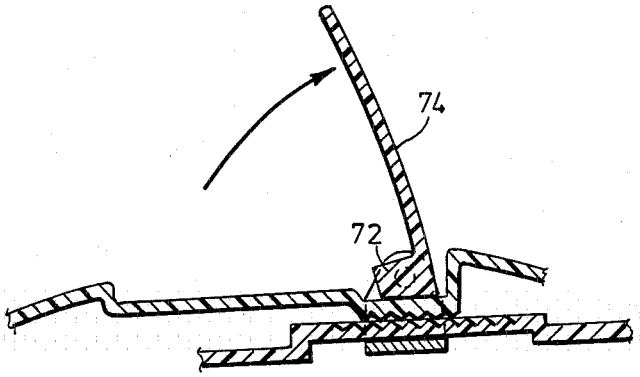
FIG. 3 is similar to FIG. 2, with the adjustment lever open.
Figure 4:
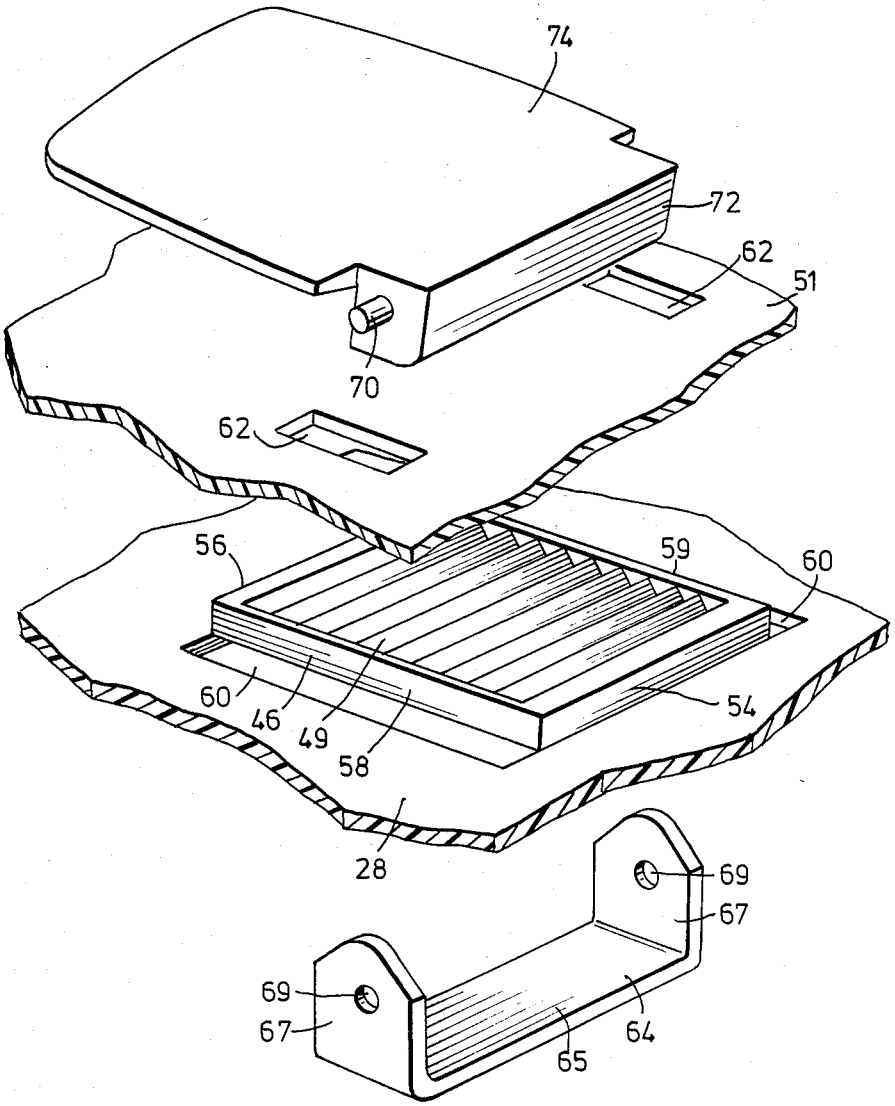
FIG. 4 is a partial exploded perspective view of the primary components of the adjustment and lock mechanism.

Looking at FIG. 4, it can be seen that the raised portion 49 is substantially rectangular, and is attached to the side wall 28 only at opposite edges 54 and 56. Along the other edges 58 and 59 are longitudinal slots 60. Likewise, at either end of the portion 52 of the indented region 51 are slots 62. A clevis 64 includes a main portion 65 and two upstanding flanges 67, the latter being adapted to pass through the slots 60 and 62. Each of the flanges 67 has an aperture 69, and the two apertures 69 are adapted to receive two pins 70 projecting oppositely from a cam member 72 to which is integrally connected a lever 74. The cam member 72 and lever 74 are shown in section in FIGS. 2 and 3, and in perspective in FIG. 4.

As can clearly seen in FIG. 2, the shape and size of the cam member 72 is such that, when it is rotated into the position shown in FIG. 2, the cooperation between the cam member 72 and the clevis 64 retains the teeth defined on the portions 46 and 52 together so that they cannot become disengaged. In FIG. 2, the lever 74 lies along the side portion 20 and more particularly lies within a recess 76 which is provided in the side portion 20 for this purpose.

In FIG. 3, the lever 74 has been rotated in a clockwise direction, thus rotating the cam member 72 to a position in which the teeth of the portions 46 and 52 are released from engagement, thus permitting the shells 12 and 14 to be shifted in the front-to-back direction with respect to each other.

The other side of the helmet is identical to that shown in FIG. 1, and thus includes a further assembly structure the same as that shown in FIGS. 2, 3 and 4. Thus, when the wearer of the helmet wishes to adjust its size by shifting one shell with respect to the other, he needs merely flip the levers 74 outwardly at the sides of the helmet, then move the shells to the desired relative position, then press the levers 74 back into place within the recesses 76.

While a particular embodiment of this invention has been illustrated in the accompanying drawings and described hereinabove, it will be apparent to those skilled in the art that changes and modifications may be made therein without departing from the essence of this invention as set forth in the appended claims.

I claim:

1. A helmet comprising:

a front shell, a rear shell movable in the forward-rearward direction with respect to the front shell, portions of the two shells overlapping each other and presenting mating surfaces with interengageable protuberances which can engage each other to retain the shells in a given overlapping position, and can disengage to allow the shells to change their relative position, and cam means for selectively (a) holding the mating surfaces in engagement, and (b) releasing them to disengage, the cam means including two cam members recessed into two recesses on either side of the said portion which lies outwardly of the other, each cam member being swivelable about an axis which is retrained with respect to the inwardly lying mating surface, each cam member being adapted to urge the two mating surfaces into engagement, each cam member being integral with a cam-operating lever which is accessible from the exterior of the helmet and by which the cam member can be rotated about its respective axis, each said lever being wholly recessed into the recess of its respective cam member when the latter is urging the two mating surfaces into engagement, each said lever being swingable to a position in which it extends generally outwardly away from the helmet, in which position the cam member releases the mating surfaces.

2. The helmet claimed in claim 1, in which each said axis is defined by a bracket having tabs extending through slot means in both shells, the tabs having sockets into which extend pins fixed to the cam member.

* * * * *